United States Patent [19]

Grimpe et al.

[11] 4,037,452

[45] July 26, 1977

[54] GROUP GEARING ARRANGEMENT IN A CONTINUOUS ROLLING MILL

[75] Inventors: Karl Grimpe, Mulheim; Erich Reth, Duisburg, both of Germany

[73] Assignee: Demag Aktiengesellschaft, Duisburg, Germany

[21] Appl. No.: 685,175

[22] Filed: May 11, 1976

[30] Foreign Application Priority Data

May 14, 1975 Germany ..... 2521393

[51] Int. Cl.[2] ..... B21B 35/02

[52] U.S. Cl. ..... 72/249

[58] Field of Search ..... 72/249; 74/665 GA

[56] References Cited

U.S. PATENT DOCUMENTS 3,867,826 2/1975 Noe ..... 72/249

*Primary Examiner*—Milton S. Mehr

*Attorney, Agent, or Firm*—Mandeville and Schweitzer

[57] ABSTRACT

The invention covers a group gear for the rollers of individual stands, driven by a motor via one common main drive shaft, of a continuous rolling mill, particularly for a wire manufacturing block where the secondary drive speed is picked up by the main drive shaft via the respective bevel gear stage, and then transmitted to the rolling mill shafts.

4 Claims, 1 Drawing Figure

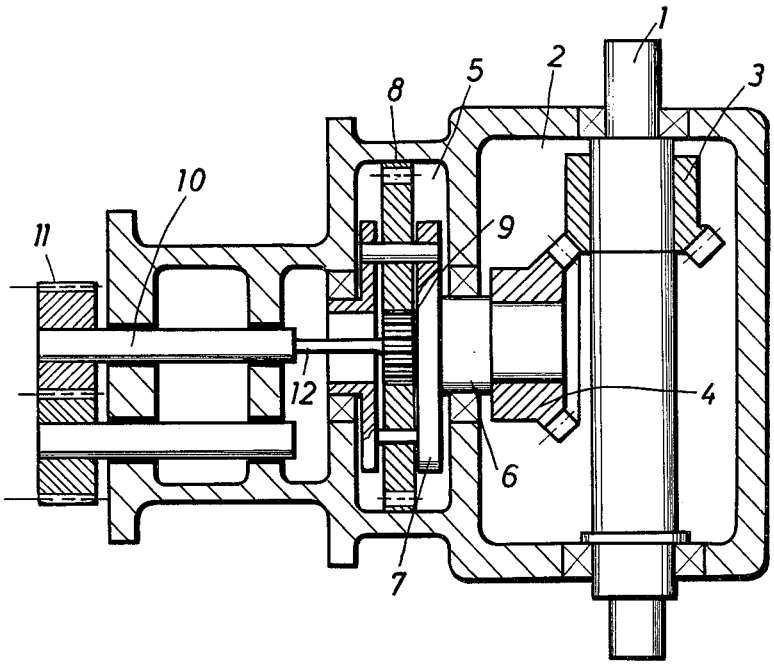
1
2
3
4
5
6
7
8
9
10
11
12

GROUP GEARING ARRANGEMENT IN A CONTINUOUS ROLLING MILL

BACKGROUND AND SUMMARY OF THE INVENTION

The known gear has the disadvantage of not permitting a further increase of speed, and consequently of the peripheral velocity on account of the limited manufacturing precision of the bevel gears, so that the speed of the finished rolled product is limited and no longer suffices for today's requirements. In order to increase the velocity of the finished rolled product, it has been suggested to utilize pinion gear stages from secondary drive to secondary drive, their gear ratio either being the same in all stages or possibly increasing from stage to stage in rolling direction.

However, the pinions in such gearing arrangements, particularly the last stage in rolling directon, reach such high peripheral velocities that this type of design can hardly be recommended for high speed rolling mills of the described type in view of wear, susceptibility to repair, noise development, heat vibrations, and other similar reasons. A further disadvantage is that because of the large mass to be moved, the inertia momentum and thus switching time for acceleration or deceleration of the stands become too great, i.e. the installation reacts sluggishly. Theoretically, the peripheral velocities and mass could be reduced by choosing smaller gear diameters. However, this cannot be practiced as the gear diameters are roughly predetermined by the distances between the rolling stands.

As technology of rolling and economy of a rolling mill make it imperative that a continous rolling mill has the highest possible velocity of the rolled product and that, above all, a fast regulation of the number of revolutions is possible, the present invention solves the task of improving the group gear of the initially described rolling mill in such a way that while decreasing the pinion peripheral speeds and the inertia momentum, much higher velocities of the finished product are attained without very high structural expenditures, and at the usual initial number of revolutions. To solve this, the present invention arranges a planetary gear after each bevel gear stage.

Planetary gears offer a variety of advantages over the known pinion or bevel gear arrangements. For example, the peripheral velocities of the individual gears, which may be designed smaller due to power distribution, are much lower which, in turn, results in lower inertia momentum so that much higher speeds are possible at the secondary drive without a damaging increase in speed in the preceding parts. Furthermore, planetary gears may be favorably arranged coaxially, which strongly reduces structural volume. Also, the gear efficiency of planetary gears is much better than that of pinion or bevel gear arrangements. Furthermore, they have an advantage over pinion gear arrangements in that gear ratios which require a two-stage design for pinion gear arrangements, can be realized in one stage in planetary gear arrangements. This reduces the entire gear play, which favorably affects inertia behavior.

A particularly simple and favorable construction results when, according to another feature of the invention, the planetary gear arrangement forms a structural unit with the bevel gear arrangement. In this manner, it is possible to further reduce gear play in the entire train. It is advantageous to arrange one bevel gear directly at the pinion cage. In view of stability and inertia resistance of the gear arrangement, it is also preferable if the sun gear of the planetary gear arrangement is arranged "flying" or cantilevered at the end of the rolling mill shaft outside the bearing therefor facing away from the rollers. In this case the rolling mill shaft is designed to permit free adjustability of the sun gear.

DESCRIPTION OF THE DRAWING

The drawing is a schematic illustration of a gearing arrangement embodying the invention for use in a stand of a rolling mill.

DETAILED DESCRIPTION OF THE INVENTION

1 stands for the common main drive shaft, which goes through bevel gear arrangement 2. Bevel gear arrangement 2 consists of bevel gears 3 and 4, gearing together, whereby bevel gear 4 is arranged directly at a peg-shaped extension 6 of pinion cage 7 of the planetary gear arrangement 5. The planetary gear arrangement 5 consists of pinion cage 7, planetary gears 8 which gear with sun gear 9. Sun gear 9 is arranged directly on the rolling mill shaft 10 of pinions 11, whereby the rolling mill shaft 10 has a reduced diameter at 12 so that the sun gear may be adjusted in view of planetary gears 8. Pinions 11 gear directly with the drive pinions of the rolling mill rollers (not shown).

We claim:

1. A gear arrangement for driving the individual stands of a continuous rolling mill, particularly for a wire manufacturing block comprising a. a motor;
b. a common main drive shaft driven by said motor;
c. a secondary speed drive shaft for each stand;
d. a bevel gear arrangement disposed between said main drive shaft and each said secondary speed drive shaft; characterized by
e. a planetary gear connecting said bevel gear arrangement to each said secondary speed drive shaft, and
f. the sun gear of said planetary gear is fixed on one end of said secondary speed drive shaft outside the bearings therefor.

2. The apparatus of claim 1, further characterized by
a. said secondary speed drive shaft has a portion of reduced diameter extending at one end thereof;
b. said reduced portion extending outside the spaced bearings for said secondary speed drive shaft; and
c. said sun gear fixed on the end of said reduced portion.

3. The apparatus of claim 1, further characterized by
a. said bevel gear arrangement and said planetary gear are a single structural unit.

4. The apparatus of claim 1, further characterized by
a. one bevel gear of said bevel gear arrangement is fixed to the pinion cage of said planetary gear.

* * * * *